US006205627B1

(12) United States Patent
Hoika

(10) Patent No.: US 6,205,627 B1
(45) Date of Patent: Mar. 27, 2001

(54) SAFETY BELT BUCKLE

(75) Inventor: Christian Hoika, Vellberg-Lorenzenzimmern (DE)

(73) Assignee: TRW Occupant Restraint Systems GmbH & Co. KG, Alfdorf (DE)

( * ) Notice: Subject to any disclaimer, the term of this patent is extended or adjusted under 35 U.S.C. 154(b) by 0 days.

(21) Appl. No.: 09/335,543

(22) Filed: Jun. 18, 1999

(30) Foreign Application Priority Data

Jun. 18, 1998 (DE) ..... 298 10 954 U

(51) Int. Cl.[7] ..... A44B 11/25
(52) U.S. Cl. ..... 24/633; 24/637; 24/641
(58) Field of Search ..... 24/633, 636, 637, 24/641

(56) References Cited

U.S. PATENT DOCUMENTS

| | | | | |
|---|---|---|---|---|
| 4,163,128 | * | 7/1979 | Miskowicz | 200/61.58 B |
| 4,542,563 | * | 9/1985 | Befort | 24/641 |
| 4,677,715 | * | 7/1987 | Escaravage | 24/641 |
| 4,677,716 | * | 7/1987 | Monsigny | 24/641 |
| 4,685,177 | * | 8/1987 | Escaravage | 24/641 |
| 4,703,542 | | 11/1987 | Hirata et al. . | |
| 5,123,147 | | 6/1992 | Blair . | |
| 5,784,766 | * | 7/1998 | Downie et al. | 24/641 |

FOREIGN PATENT DOCUMENTS

| | | |
|---|---|---|
| 90034422 | 7/1990 | (DE) . |
| 0131255 | 1/1985 | (EP) . |
| 0318031 | 5/1989 | (EP) . |
| 2211242 | 6/1989 | (GB) . |

* cited by examiner

*Primary Examiner*—Victor N. Sakran
(74) *Attorney, Agent, or Firm*—Tarolli, Sundheim, Covell, Tummino & Szabo L.L.P.

(57) ABSTRACT

A belt buckle for vehicle safety belts has a load bearing frame and a locking mechanism thereon. A housing encloses the frame and has an insertion slot for an insert tongue acting in conjunction with the locking mechanism. To eliminate any extraneous matter that has entered into the housing through the insertion slot, a channel leads from the insertion slot through the housing and out of the housing, forming a guide for gravity assisted movement of such extraneous matter out of the housing.

10 Claims, 2 Drawing Sheets

12
10
24
30
36
36
20
38
32
40
14
42
18
22
46
44
34
30
16

I
24
10
20
28
26
I

SAFETY BELT BUCKLE

FIELD OF THE INVENTION

The present invention relates to a belt buckle for vehicle safety belts.

BACKGROUND OF THE INVENTION

Belt buckles generally have a load bearing frame attached to the vehicle floor or the like by means of a suitable attachment fitting, a locking mechanism arranged at the frame, and a housing which encloses the frame and which has an insertion slot for an insert tongue acting in conjunction with the locking mechanism. This insertion slot must be free and open so as not to obstruct the insertion of the tongue into the belt buckle when the safety belt is to be used. The open and unobstructed insertion slot, however, also allows the entry of extraneous matter into the inner space of the belt buckle. Examples of such extraneous matter are liquids (drinks), glass splinters (accident, break-in), fruit pips, rice grains, fibres, grit, gravel and the like. Hard matter, in particular, but also sticky liquids can impair or even impede the function of the locking mechanism. If proper locking is not achieved, the safety belt is not capable of fulfilling its protective function. Incomplete locking, also known as "pseudo-locking", is particularly dangerous, since the vehicle occupants are unable to detect this condition.

SUMMARY OF THE INVENTION

The invention eliminates this safety deficiency inherent in all known belt buckles.

According to the invention, at least one channel leads from the insertion slot for the insert tongue through the housing and out of it in such a way that any extraneous matter which may have entered through the insertion slot is guided out of the housing along the channel as assisted by gravity. Whilst with conventional embodiments of belt buckles the aim was to close the insertion slot through the insert tongue ejector as completely as possible, the invention follows the opposite strategy: Having realized that it is not possible in practice to prevent the entry of extraneous matter through the insertion slot for the insert tongue, the invention makes a point of even favoring such entry of such grit particles and foreign bodies through the channel formed within the belt buckle, so that these may leave the belt buckle housing on a direct route through the channel. It is, in fact, the agglomeration of dirt and other foreign matter in the area of the insertion slot for the insert tongue that will find its way into the interior of the belt buckle housing when the tongue is inserted or the release button is pressed.

In the preferred embodiment of the belt buckle, the insert tongue ejector, as opposed to known embodiments where its width coincides with that of the front end of the insert tongue in order to close up the insertion slot as much as possible when the insert tongue is released, is of reduced width so as to obtain free space on both sides of the ejector for a channel for the elimination of dirt and other foreign matter. The ejector is furthermore provided with guide surfaces at its outer end in order to favor the entry of foreign matter into the two channels.

BRIEF DESCRIPTION OF THE DRAWINGS

Further advantages and characteristics of the invention read from the following description of several embodiments, as well as from the attached drawings, to which reference is made, showing in FIG. 1 a schematic part section of a belt buckle along section I—I in FIG. 2.

DETAILED DESCRIPTION

Figure 1:
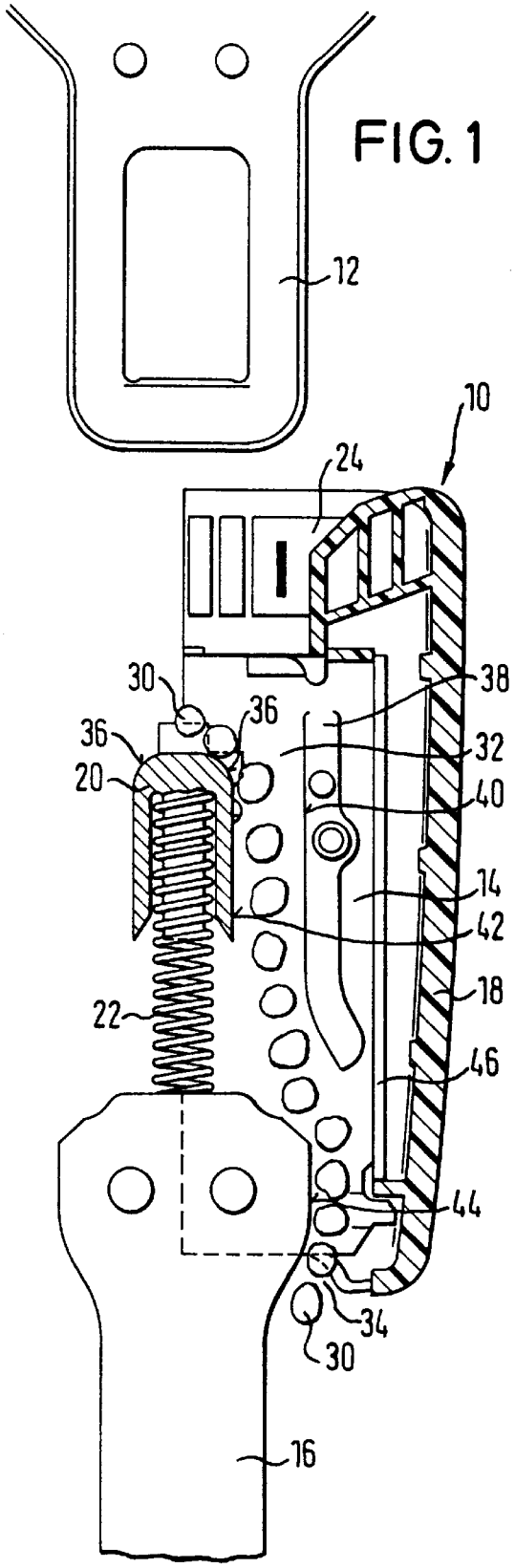

The belt buckle 10 shown in FIG. 1 serves to lock the insert tongue 12 of a safety belt not shown here. To this effect, the insert tongue 12 is pushed, from the position shown in FIG. 1, into the belt buckle 10 and is locked there by means of a conventional locking mechanism which is not shown here. A release button, also of conventional design and not shown here, serves to release the locking mechanism. The belt buckle 10 has a frame 14 which is connected to the vehicle body or to a seat within the vehicle by means of an attachment fitting 16.

The sectional view of FIG. 1 furthermore shows a housing half 18 which partly surrounds the frame 14. As with conventional belt buckles, the housing surrounding the frame 14 consists of two halves, of which only one, that is the half-housing 18, is shown in the illustrations. An insert tongue ejector 20, which is pre-tensioned against the insert direction of the insert tongue 12 by means of a compression spring 22, is arranged centrally within the frame 14 of the belt buckle 10. As the insert tongue 12 is inserted into the belt buckle 10, the insert tongue ejector 20 is moved downwards, and the compression spring 22 is compressed. When the locking mechanism of the belt buckle 10 is unlocked by pushing the release button, the insert tongue ejector 20 pushes the insert tongue 12 out of the belt buckle 10, so that the corresponding safety belt is released.

Figure 2:
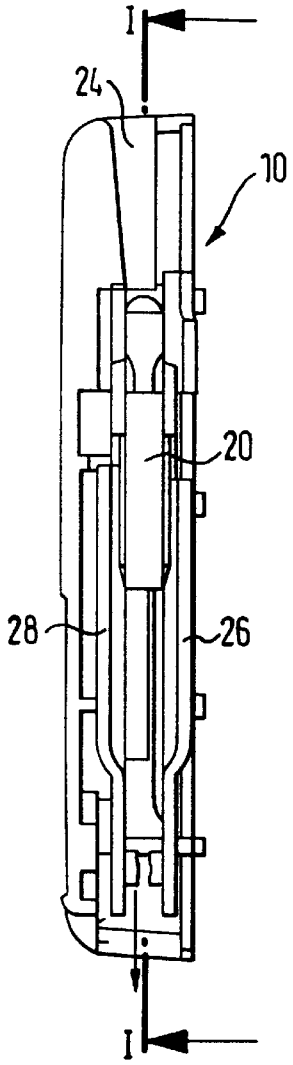
FIG. 2 a schematic view of a narrow side of the belt buckle.

As can be seen from FIG. 2, the belt buckle 10 has an insertion slot 24 for both the insertion and the ejection of the insert tongue 12. The frame 14 of the belt buckle 10 is made up of two parallel plates 26 and 28, between which the insert tongue ejector 20 is movably arranged. The plates 26 and 28 are arranged at a distance from each other which essentially corresponds to the thickness of the insert tongue 12, making sure that it is guided between the plates 26 and 28 in a safe way. When the insert tongue 12 is not inserted, that is in the condition illustrated in the Figures, the insertion slot 24 is open and dirt and foreign bodies are free to enter into the insertion slot 24.

Such foreign bodies 30 are shown in FIG. 1. The foreign bodies 30 enter the inside of the belt buckle 10 via the insertion slot 24. Channels 32 lead from the insertion slot 24 through the belt buckle 10, and the intruding foreign bodies 30 are made to travel through these channels 32 and consequently through the belt buckle 10 in the direction of the arrow indicated in FIG. 2. Since the foreign bodies 30 are conveyed through the belt buckle 10 to be then expelled from it, no jamming of the locking mechanism can occur and malfunctions of the belt buckle 10, in particular the condition of pseudo-locking, are prevented.

As is shown again in FIG. 1, the foreign bodies 30 which have entered through the insertion slot 24 are made to move along the channel 32, assisted by their gravity and by the vibration of the vehicle, and are then conveyed through the channel 32 and expelled from the belt buckle 10 and the housing of the belt buckle, respectively, through an opening 34 of the housing, which is essentially opposite the insertion slot 24. The channels 32 are formed between the parallel plates 26 and 28 of the frame 14 and on both sides of the insert tongue ejector 20. To this end, the insert tongue ejector 20 is made relatively narrow with respect to the width of the insertion slot 24, which corresponds essentially to the width of the insert tongue 12. At its end facing the insert tongue 12 and the insertion slot 24, respectively, the insert tongue ejector 20 is rounded and therefore provided with guide surfaces 36 which open out into the channels 32. Any foreign bodies 30 that enter are guided sideways by these guide surfaces 36 and into the channels 32. Embossments 38 are provided in the parallel plates 26 and 28 of the frame on both sides of the insert tongue ejector 20. By these embossments 38, guide surfaces 40 are formed between the plates 26 and 28, so that the channels 32 in the area of the insert tongue ejector 20 are delimited by its lateral surfaces 42, the facing inner surfaces of the plates 26 and 28, as well as by the guide surfaces 40 formed by the embossments 38. The embossments 38 extend not only over the area of the insert tongue ejector 20, but further through the belt buckle 10 and thereby delimit the channels 32 also in their further extension. The channels 32 are then delimited in the lower area of the belt buckle 10 by the lateral surfaces 44 of the attachment fitting 16 and by the guide surfaces 46 formed on the plates 26 and 28. Once the foreign bodies 30 have passed the belt buckle 10 through the channel 32, as shown in FIG. 1, these then leave the housing of the belt buckle 10 adjacent to the attachment fitting 16. In order to ensure that even fairly large foreign bodies, such as apple pips or glass splinters, are able to leave the belt buckle 10 through the channels 32, the channels 32 are designed to have a cross section of approximately 4 $mm^2$ to 10 $mm^2$.

Figure 3:
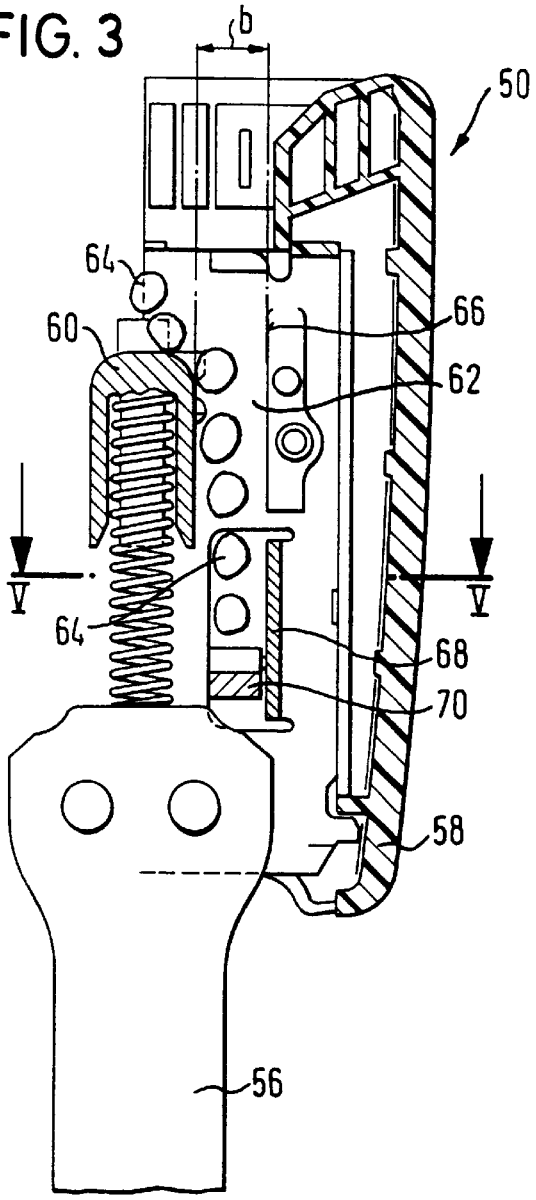
FIG. 3 a sectional view of a second embodiment along section III—III in FIG. 4.
Figure 4:
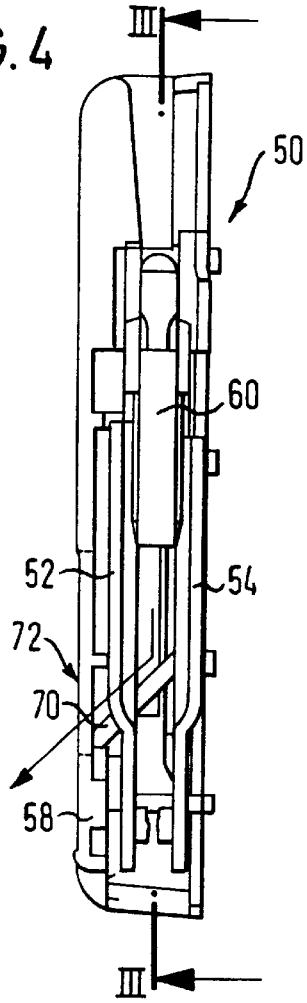
FIG. 4 a schematic side view of the belt buckle embodiment shown in FIG. 3, and FIG. 5 a sectional view along section V—V in FIG. 3.
Figure 5:
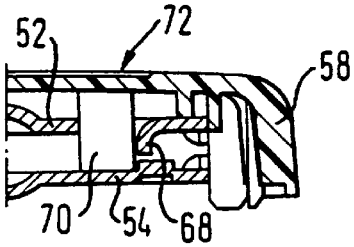

A further embodiment of the belt buckle according to the invention, similar in design to the belt buckle shown in FIGS. 1 and 2, is illustrated in FIGS. 3 to 5. Here, the belt buckle 50 also has a frame consisting of two parallel plates 52 and 54 which are connected to a vehicle structure by means of an attachment fitting 56. The belt buckle 50 has a plastic housing consisting of two housing halves, of which only one housing half 58 is shown in the illustrations. Channels 62 are formed on each side of the movably provided insert tongue ejector 60 positioned between the plates 52 and 54, through which channel any foreign bodies 64 which have penetrated the belt buckle 50 are once more expelled, gravity assisted, from the belt buckle 50 and its housing. The plates 52 and 54 have embossments 66 in the area of the insert tongue ejector 60 which act as lateral limits to the channel 62, so that the channel 62 is of width b. The width b of the channel 62 also remains essentially constant within the further extension of channel 62 through the belt buckle 50, since the embossment 66 is followed by an angled sheet metal lug 68, forming an integral part of plate 52 and constituting a further guide surface to delimit the channel 62.

In the lower section of the belt buckle 50, the channel 62 is delimited in its longitudinal direction by a ramp 70 formed to the housing half 58, which extends from the housing half 58 to the plate 54 through the plate 52 and the channel 62. As can be clearly seen from FIG. 4, the ramp 70 is positioned at an angle to the longitudinal direction of the channel 62, so that any foreign bodies 64 moving along the channel 62 are deflected from the longitudinal direction of the channel 62 and are expelled from the housing of the belt buckle 50 through an opening 72 provided in the housing half 58 in the direction indicated by an arrow in FIG. 4.

What is claimed is:

1. A belt buckle for vehicle safety belts, comprising a load bearing frame, a locking mechanism on the frame and a housing enclosing the frame, said housing having an insertion slot for an insert tongue cooperating with the locking mechanism, at least one continuous channel within said housing flowingly connecting said insertion slot through and out of the housing, said channel forming a guide for gravity assisted movement of extraneous matter penetrating into the housing through said insertion slot to remove said extraneous matter from said housing.

2. The belt buckle according to claim 1, wherein said channel is formed between two parallel plates of the frame.

3. The belt buckle according to claim 2, wherein the channel is formed between embossments of the frame plates.

4. The belt buckle according to claim 1, wherein the channel is formed adjacent to an insert tongue ejector.

5. The belt buckle according to claim 4, wherein said insert tongue ejector is provided with guide surfaces (36) leading into the channel.

6. The belt buckle according to claim 1, wherein one said channel is formed on each of two sides of an insert tongue ejector.

7. The belt buckle according to claim 1, wherein the channel has an outlet from the housing adjacent to an attachment fitting connected to the frame.

8. The belt buckle according to claim 1, wherein the channel leads out of the housing at an opening in a housing wall near an attachment fitting connected to the frame.

9. The belt buckle according to claim 8, wherein guide structures are integrally molded with at least one housing wall.

10. The belt buckle according to claim 1, wherein said channel has a cross-sectional area of approximately 4 to 10 $mm^2$.

* * * * *